US006263881B1

(12) United States Patent
Kuhl et al.

(10) Patent No.: US 6,263,881 B1
(45) Date of Patent: Jul. 24, 2001

(54) APPARATUS FOR APPLYING A LIQUID MEDIUM TO TOBACCO

(75) Inventors: Volker Kuhl; Thomas Jung, both of Bayreuth (DE)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/404,125

(22) Filed: Sep. 23, 1999

(30) Foreign Application Priority Data

Sep. 29, 1998 (DE) ..... 198 44 682

(51) Int. Cl.[7] ..... A24C 1/18; A24C 5/18; A24B 3/12

(52) U.S. Cl. ..... 131/79; 131/31; 131/84.1; 131/84.3; 131/280; 131/290

(58) Field of Search ..... 131/79, 280, 309, 131/31, 84.3, 310, 62, 84.1, 290

(56) References Cited

U.S. PATENT DOCUMENTS 4,913,166 * 4/1990 Christensson et al. ..... 131/31
4,993,434 * 2/1991 Haws et al. ..... 131/79
4,995,405 * 2/1991 Lettau ..... 131/84.1

FOREIGN PATENT DOCUMENTS 2254063 11/1976 (DE) .
3844620 6/1990 (DE) .
3821677 1/1991 (DE) .

* cited by examiner

*Primary Examiner*—James Derrington
*Assistant Examiner*—Dionne A. Walls
(74) *Attorney, Agent, or Firm*—John F. Salazar; Middleton & Reutlinger

(57) ABSTRACT

The invention relates to an apparatus for applying a liquid medium, more particularly, a flavor or menthol, to tobacco in a cigarette maker equipped with a conduit for feeding the liquid medium, and provided at the end of the conduit with a nozzle orifice, disposed under the suction band of a cigarette former of the maker and, through its nozzle orifice, applies the liquid medium to the tobacco in contact with the tobacco carpet. The nozzle orifice sweeps past the surface of the tobacco and applies a fine continuous jet of the non-foamed liquid medium, or an aerosol jet of the liquid medium, onto the tobacco.

14 Claims, 4 Drawing Sheets

APPARATUS FOR APPLYING A LIQUID MEDIUM TO TOBACCO

BACKGROUND OF THE INVENTION

1. Field of the Invention

The invention relates to an apparatus for applying a liquid medium, more particularly, a flavor or menthol, to tobacco in a cigarette maker of the kind set forth in the preamble of claim 1.

In cigarette production it is known to add various materials to the tobacco for the purpose of improving certain properties of the finished cigarette, flavor and menthol being the best known materials, and are applied to the tobacco in the liquid condition.

It is important in this respect that the added material is distributed uniformly over the tobacco so that all cigarettes produced have the same properties.

In addition, the liquid medium itself needs to be added uniformly so that each and every cigarette has consistent smoking performance from the first to the last puff.

2. Description of Prior Art

For this purpose, DE 22 54 063 C3 discloses a method of producing cigarettes in which the liquid medium is sprayed onto the tobacco in the form of an aerosol downstream of the distributor and just before enwrapping the tobacco carpet with a garniture tape.

Another method reads from DE 38 44 620 C2 in which the liquid medium is sprayed onto the tobacco carpeted on the suction band of the cigarette maker. In this arrangement, the liquid conduit connecting the pump to the injector is required to have a diameter of less than 1 mm so that the response delay in adapting the volume of the liquid to the working speed of the cigarette maker is at a minimum. The injector for the liquid medium is positioned in the stack under the suction band at a location at which the thickness of the tobacco layer carpeted on the suction band corresponds to approximately half the thickness of the final tobacco carpet. The injector is inclined in the conveying direction of the carpeted tobacco, namely at an angle of approximately 45° to the conveying direction, and the liquid medium is sprayed as an airless, concentrated jet of liquid onto the surface of the tobacco. The orifice of the injector is positioned at a distance from the surface of the tobacco.

A similar method reads from DE 38 21 677 C2.

An apparatus for applying a liquid medium, especially flavor or menthol, onto tobacco in a cigarette maker of the aforementioned kind is disclosed by U.S. Pat. No. 4,619,276 and comprises a conduit for supplying the liquid medium as well as a nozzle fed by the conduit, which is likewise disposed under the suction band of a cigarette former of the cigarette maker, and the liquid medium is sprayed, through the nozzle orifice, onto the tobacco.

To prevent the liquid medium from spotting the cigarette paper, the liquid medium is applied in the form of foam, this, however, necessitating a complicated conditioning of the liquid medium.

The orifice is distanced approximately 1 inch from the suction band, and is oriented either perpendicular or parallel to the suction direction of the tobacco. No details are given as to the distance between the nozzle orifice and the carpeted tobacco.

With all of these known methods, the same problem is encountered in actual practice: there is no preventing subsequent tobacco from also being sprayed and randomly carpeted in the stack or passage ledge region under the suction band, which leads to increased spotting of the cigarette paper. In addition to this, the stack under the suction band is also wetted with the liquid medium so that subsequent particles collect there and may be entrained at random which, likewise, results in spotting of the cigarette paper.

In addition, the location of the outlet orifice changes in the stack under the suction band, as does its angle of adjustment to the rod of tobacco being formed, this, on the one hand, differing from one type of maker to the other and, on the other, with a fluctuation in the application weight of the tobacco since the height of the tobacco rod forming at the spray point fluctuates correspondingly, so that, likewise, there is no preventing of intensified spotting.

An additional problem is that the orifice and its conduit are located in the upswept suction stream of tobacco, therefore, there is a risk that the tobacco will collect there, resulting in a tobacco "stopper" nuisance.

SUMMARY OF THE INVENTION

It is, thus, the object of the present invention to provide an apparatus for applying a liquid medium, more particularly, a flavor or menthol, to tobacco in a cigarette maker of the kind cited above, and which obviates the aforementioned drawbacks.

More particularly, the intention is to provide an apparatus which practically excludes the risk of the cigarette paper being spotted by the liquid medium while, simultaneously, reliably preventing tobacco stoppers.

This is achieved in an inventive manner by the features of claim 1.

Expedient embodiments are defined by the features of the sub-claims.

The advantages afforded by the invention are based on the apparatus functioning as follows: the outlet nozzle for the liquid medium is located under the suction band at a point where the tobacco adhering to the suction band sweeps past and contacts the nozzle orifice. This, first of all, guarantees that the spray point on the tobacco is precisely defined and is exactly determined so that, during subsequent forming of the rod of tobacco in the format finger, the spray area is completely surrounded by tobacco. The liquid medium then diffuses from the spray point, which is located roughly in the middle of the rod of tobacco, through the tobacco and outwards but does not reach the cigarette paper, thus reliably preventing spotting.

At the same time, the other particles of the tobacco carpet adhering to the suction band come into contact with the nozzle orifice causing it to continually vibrate. It is this vibration that stops tobacco fibers from collecting at the nozzle orifice and at the feed conduit thereto, thus preventing tobacco stoppers.

The chimney stack under the suction band, also termed "skirting" does not require altering for fitting the sprayer in accordance with the invention since the feed conduit for the nozzle may now be secured outside of the stack.

Since a non-foamed liquid medium is used there is now no need for complicated conditioning of a foamed liquid medium.

In accordance with one preferred embodiment, the nozzle orifice is located under the middle of the suction band and is oriented such that the fine, continuous jet of the non-foamed liquid medium impinges the surface of the tobacco at an angle between 45° and 90°. For this purpose, the feed conduit runs parallel to the suction band in the direction of production and is then curved in the direction of the suction band.

To guarantee the aforementioned vibration of the conduit and nozzle orifice, the diameter of the conduit should be a maximum of approx. 5 mm, a diameter of 2 to 4 mm being preferred. On the outside, the conduit should consist of an elastic material, more particularly, stainless steel or hardened tool steel.

Another consequence of the small diameter of the conduit is that the cross-section of the stack under the suction band and thus, the rising stream of tobacco, is only influenced to a minimum degree, likewise avoiding tobacco stoppers.

The feed conduit for the nozzle orifice may be formed by a single-wall tube, however it is also possible that it be formed by a double-wall tube, so that two feed passages exist.

Via one passage the liquid medium is admitted, and via the other, a propellant gas, more particularly air.

Preferably the liquid medium is guided through the central passage and a propellant gas through the outer annular passage.

The outer annular passage, through which the propellant gas or the liquid medium is admitted, is dimensioned so that, in subsequently mixing propellant gas and liquid medium, aerosolization may take place.

At the end of the outer annular passage, a cylindrical ring having spirally guided passageways is inserted which swirls the throughflow of the liquid medium, i.e. the propellant gas or flavor/menthol, to enhance aerosolization. The swirl openings may be optionally ported into the inner or outer tube.

In accordance with a further embodiment of a double-wall, tubular feed conduit for the nozzle orifice, the liquid medium—before being applied to the tobacco rod—is atomized in an aerosolization chamber of the conduit prior to emerging from the nozzle orifice as an aerosol for application to the surface of the tobacco adhering to the suction band.

In the case of some liquid media it is good practice to heat the tubular feed conduit up to the nozzle orifice to a suitable temperature which is still below the boiling point of the liquid medium, since the resulting change in viscosity facilitates application.

For this purpose, a tubular single-band feed conduit may be made of a material which warms up on application of a voltage, i.e. the feed conduit itself forming a kind of resistance heating.

In the case of a tubular double-wall feed conduit either the propellant gas may be heated externally and thus serve as the heating agent, or the tubular walls of the feed conduits may be likewise made of a material which warms up on application of a voltage, i.e. the feed conduit itself forming a kind of resistance heating.

The curved radius of the feed conduit from its straight portion up to the nozzle orifice needs to be selected as small as possible, while simultaneously ensuring that the tobacco is able to flow by from the distributor chimney.

The spacing between the assembly location of the feed conduit, located as a rule in the face end of the distributor chimney, and the nozzle orifice depends on the geometry of the distributor chimney and the skirtings and is preferably selected so that the tubular feed conduit is fitted in a portion in which it obstructs the cross-section of the stream of tobacco coming from below out of the distributor chimney only to a minimum degree, and thus avoid tobacco stoppers. At the same time, suitably designing of this spacing ensures that the liquid medium is applied pin-pointed.

The present apparatus thus enables the liquid medium to be applied pin-pointed either as a fine jet of liquid or as a fine aerosol jet from below to the surface of the tobacco adhering to the suction band at a point forming the inner portion of the, what is to be later, cigarette, thus reliably avoiding spotting.

Since the feed conduit to the nozzle orifice is elongated, running parallel to the suction band and curved in the direction thereof, i.e. fitted in the stack under the suction band in the direction of production, tobacco stoppers are avoided in the distributor chimney of the cigarette maker.

Pin-pointing application may be freely selected by shifting the tubular feed conduit in or contrary to the direction of production, it being particularly suitable to select a point in the first half of the suction band, beginning at the first point of contact of the tobacco with the suction band. The distance of the nozzle orifice point from the suction band or from the tobacco rod being formed may be freely selected for direct application of the liquid medium with simultaneous contact of the nozzle orifice with the tobacco rod, namely punctiform by a jet of liquid or as a fan of aerosol.

As an alternative to this a somewhat larger distance may be selected while still ensuring, however, that the particles adhering to the tobacco rod come into contact with the feed conduit and are thus caused to vibrate.

BRIEF DESCRIPTION OF THE DRAWINGS

The invention will now be described in more detail by way of example embodiments with reference to the attached schematic drawings in which.

DETAILED DESCRIPTION

Figure 1:
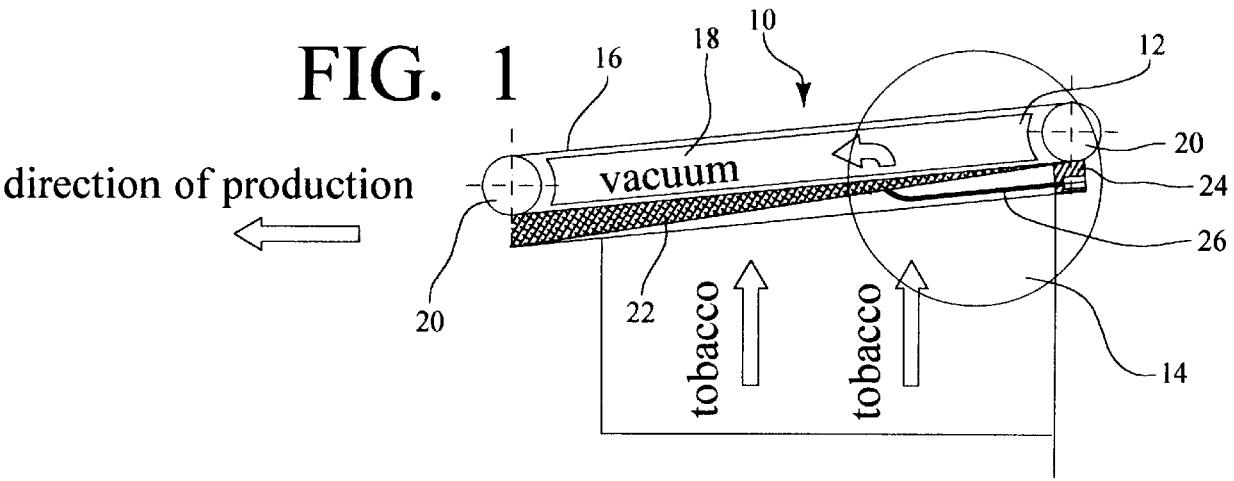
FIG. 1 is a side view of the sprayer in the distributor chimney of a cigarette maker.

FIG. 1 illustrates a distributor chimney 14 of a cigarette maker in which tobacco is suctioned through a suction arm 12 from below. The suction arm 12 comprises an endless suction band 16 guided over two pulleys 20, a vacuum chest 18 being included in the suction band.

The transport direction of the tobacco from bottom to top is indicated by the arrows. The tobacco suctioned by the suction band 16 clings to the underside of the suction band, i.e. in a carpet which increases in the direction of production, from right to left as shown in FIG. 1. At the end on the left, the carpet of tobacco 22 has attained an excessive thickness and is trimmed by an écrêteur (not shown) to the necessary thickness.

Provided in the wall of the distributor chimney 14 is a union 24 for a tubular feed conduit 26 with a nozzle orifice at the other end for applying the flavor or menthol to the surface of the tobacco rod 22 adhering to the suction band 16.

Figure 2:
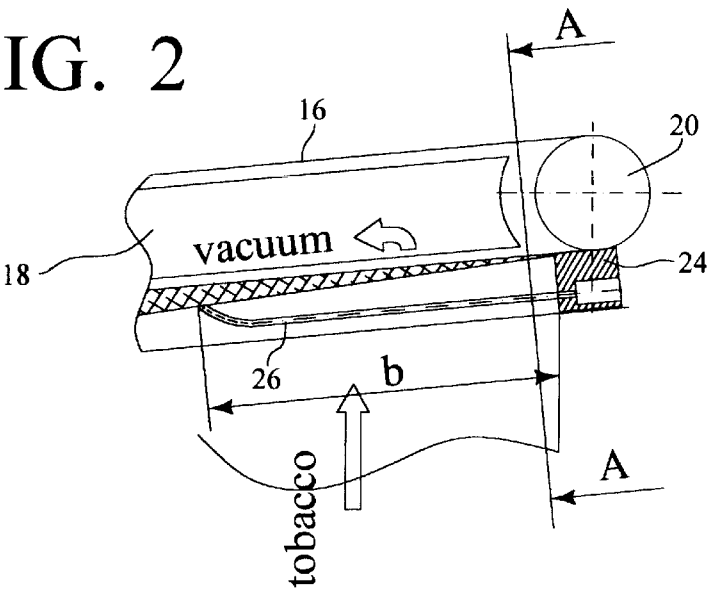
FIG. 2 is a view, on a magnified scale, of a detail encircled in FIG. 1.

FIG. 2 illustrates, on a magnified scale, the detail as encircled in FIG. 1 from which it is clearly evident that the end of the tubular conduit 26 comprising the nozzle orifice is in contact with the surface of the carpet of tobacco adhering to the suction band 16, i.e. the carpet of tobacco sweeps past the nozzle orifice.

The union 24 is connected to a supply system (not shown) for supplying the flavor or menthol from a storage tank to the union 24.

Figure 3:
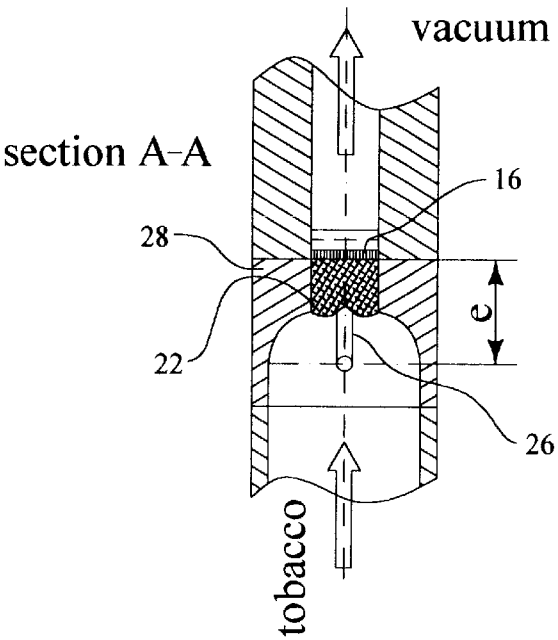
FIG. 3 is a longitudinal section taken along the line A—A from FIG. 2.

FIG. 3 illustrates a longitudinal section taken along the line A—A as shown in FIG. 2, i.e. through the stack or skirting 28 of the distributor chimney 14 comprising the suction band 16, the carpet of tobacco 22 adhering to the suction band 16 and the end of the feed conduit 26 comprising the nozzle orifice. From this it is plain to see that the feed conduit 26 is located in the middle of the skirting, and thus of the distributor chimney 14, and is surrounded by the flow of tobacco suctioned upwards.

Figure 4:
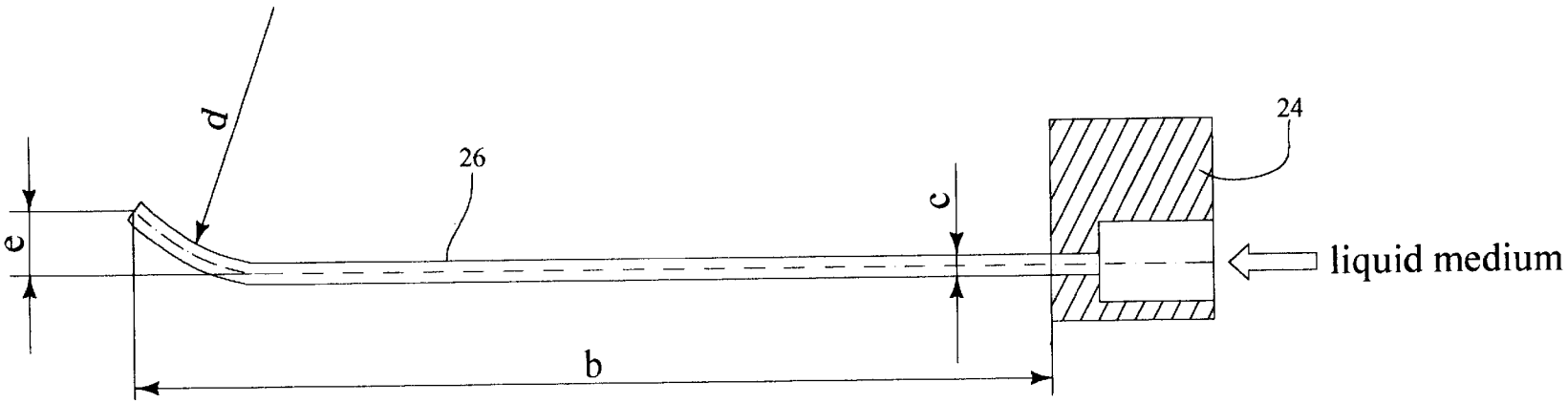
FIG. 4 is a side view of an embodiment comprising a single-wall tubular feed conduit.

FIG. 4 shows a first embodiment of the feed conduit 26, namely a single-wall tubular feed conduit extending from the union 24 in a straight line parallel to the suction band 16 in the direction of production into the distributor chimney 14 and curves approx. in the middle of the distributor chimney 14.

Figure 5:
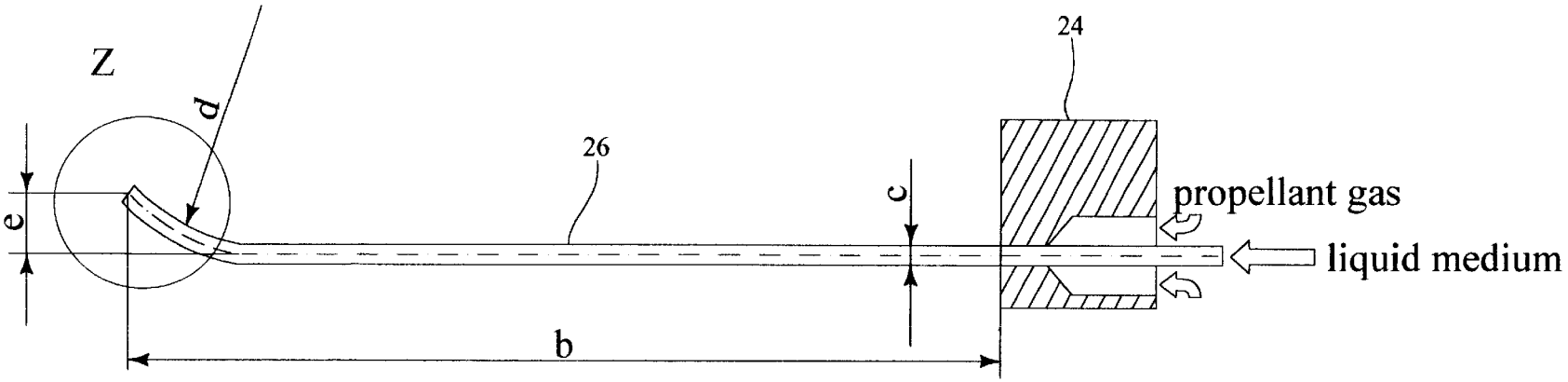
FIG. 5 is a side view of an embodiment comprising a double-wall tubular feed conduit.

FIG. 5 illustrates an embodiment comprising a double-wall tubular feed conduit 26', through the central passage of which the liquid medium, i.e. flavor or menthol, is fed, and via the annular outer passage, a propellant gas, generally air, is supplied.

The tube walls of the passage feeding the flavor or menthol are made of a material which heats up on application of a voltage, thus serving as a resistance heating. Material particularly suitable for this purpose is stainless steel or hardened tool steel which is also ductile and sufficiently elastic to permit vibration of the conduit in coming into contact with the carpet of tobacco.

The diameter c of the tubular feed conduit 26, 26' is roughly 3 mm.

The distance b from the union 24 to the nozzle orifice depends on the geometry of the distributor chimney 14 and on the skirting 28 and is selected so that the feed conduit 26 is fitted in an area in which the cross-section of the impinging stream of tobacco from below out of the distributor chimney 14 is obstructed only to a minimum extent, to thus avoid tobacco stoppers.

Generally, this distance b is approx. 25 cm.

The radius d of the curved end of the feed conduit 26, 26' is selected as small as possible, it being 20 cm in the embodiment shown. This also applies to the vertical distance e between the longitudinal direction of the feed conduit 26, 26' and the nozzle orifice which, in the embodiment shown, amounts to approx. 1.5 cm.

Figure 6:
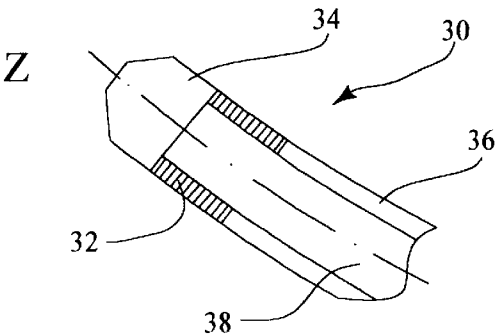
FIG. 6 is a view, on a magnified scale, of a detail taken from FIG. 5 as encircled.

FIG. 6 illustrates a view of the detail encircled in FIG. 5. The outer annular passage 36 serves to deliver the propellant gas, while the inner tube 38 feeds the liquid medium.

Provided in the outer annular passage 36 is a swirler 32 which deflects the propellant gas and thereby imparts an angular momentum to the flow.

The swirling propellant gas leaving the annular passage 36 and the liquid medium exiting from the inner tube 38 meet in an aerosolization chamber 34 in which they are swirled and mixed.

What emerges from the nozzle orifice 30 in this embodiment is thus an aerosol jet which two-dimensionally impinges the surface of the tobacco rod 22 at a precisely defined surface area.

Figure 7:
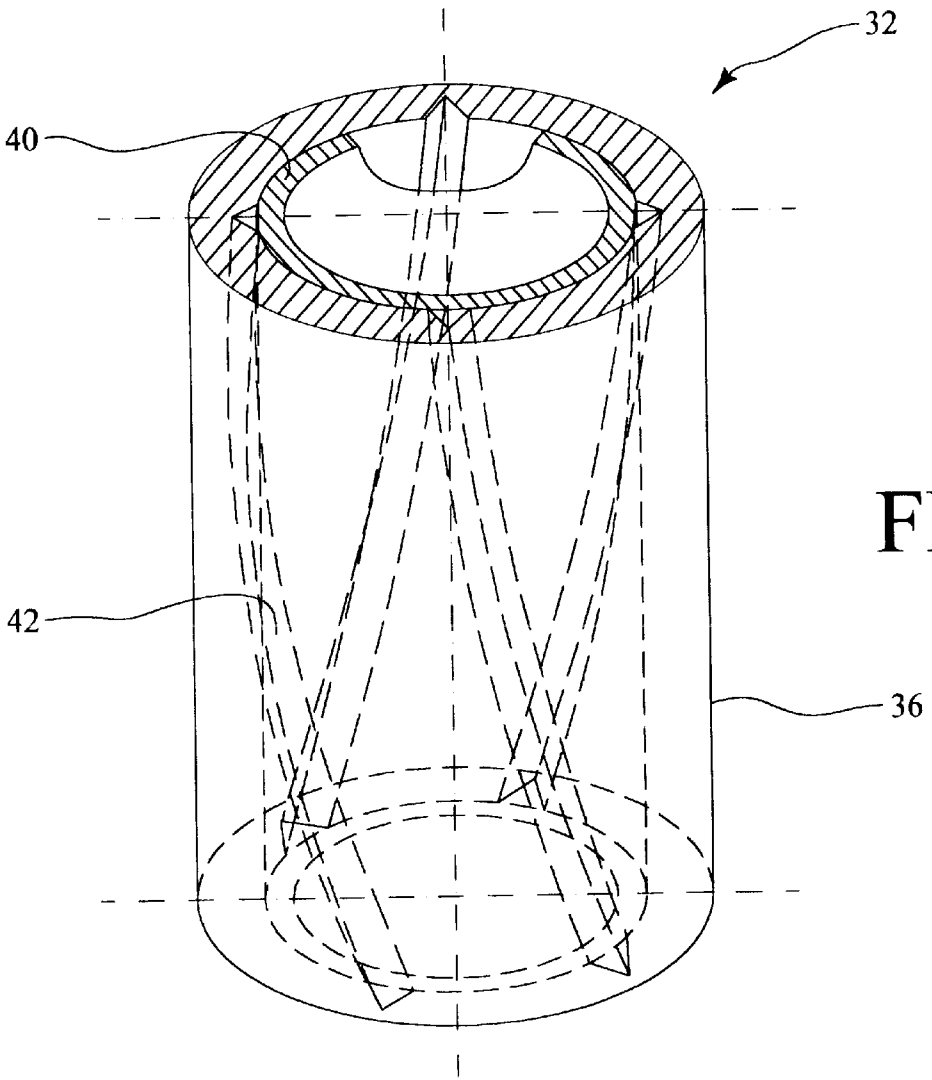
FIG. 7 is a view, on a magnified scale, of the cylindrical ring used for swirling the propellant gas.

FIG. 7 illustrates in perspective the swirler 32 formed by a cylindrical ring 40 including spiral passageways 42 and inserted in the end of the outer annular passage 36. The spiral passageways 42 deflect the liquid medium from its straight trajectory and swirl it so that it mixes with the propellant gas in a kind of agitator action to thus improve aerosolization.

Provided in the embodiment as shown are four spiral passageways 42 arranged axisymmetrically in the cylindrical ring 40, i.e. each at an angular distance of 90°. For reasons conducive to manufacture, the passageways 42 have an approximate triangular cross-section. However, other forms, arrangements and angular distances of the passageways 42 are possible.

The foregoing detailed description is given primarily for clearness of understanding and no unnecessary limitations are to be understood therefrom for modifications will become obvious to those skilled in the art upon reading this disclosure and made be made without departing from the spirit of the invention or the scope of the invention.

What is claimed is:

1. An apparatus for applying a liquid to tobacco in a cigarette maker including a) a conduit (26,26') for feeding said liquid medium and b) provided at the end of said conduit (26,26') is a nozzle orifice (30), disposed under a suction band (16) of a cigarette former (12) of said maker, for applying, through its nozzle orifice (30), a fine continuous jet of unfoamed liquid medium onto said tobacco (22) carpeted on said suction band, characterized in that c) said nozzle orifice is disposed under said suction band at a location which said tobacco adhering to said suction band sweeps along said nozzle orifice and said carpeted tobacco on said suction band directly contacts said nozzle orifice, whereby said nozzle orifice is caused to continually vibrate thereby stopping tobacco fibers from collecting at said nozzle orifice and at said conduit thereto.

2. The apparatus as set forth in claim 1 characterized in that said conduit (26, 26'), comprising said nozzle orifice (30), is made of stainless steel.

3. The apparatus as set forth in claim 1 characterized in that the outer diameter of the conduit (26), comprising said nozzle orifice (30), is between 2 to 4 mm.

4. The apparatus as set forth in claim 1 characterized in that said conduit (26, 26'), comprising said nozzle orifice (30), is configured adjustable in a direction of production.

5. The apparatus as set forth in claim 1 characterized in that said conduit (26, 26'), comprising said nozzle orifice (30), is disposed in the middle of a distributor chimney (14) under said suction band (16).

6. The apparatus as set forth in claim 1 characterized in that said conduit (26, 26'), comprising said nozzle orifice (30), is made of a material which heats up on application of a voltage.

7. The apparatus as set forth in claim 1 characterized in that said conduit (26), comprising said nozzle orifice (30), is formed by a single-wall tube (26).

8. The apparatus as set forth in claim 1 characterized in that said conduit (26'), comprising said nozzle orifice (30), is formed by a double-wall tube having an inner tube (38) and an outer ring (36) through which a propellant gas and said liquid medium are guided.

9. The apparatus as set forth in claim 8 characterized in that a swirler (32) is arranged in said outer ring (36).

10. The apparatus as set forth in claim 8 characterized in that, at the end of said conduit (26'), an aerosolization chamber (34) is configured for mixing said propellant gas and said liquid medium.

11. The apparatus as set forth in claim 1 characterized in that said conduit (26), comprising said nozzle orifice (30), is oriented in a direction of production and its end is a curved radius towards said suction band (16) and, thus, towards said tobacco (22) adhering to said suction band (16).

12. The apparatus as set forth in claim 11 characterized in that said curved radius is in the range of 15 mm to 300 mm.

13. The apparatus as set forth in claim 11 characterized in that said curved end of said conduit (26, 26') forms an angle of approximately 45° to 90° with respect to said suction band (16).

14. The apparatus as set forth in claim 11 characterized in that the distance (e) between the straight portion of said conduit (26, 26') and said curved nozzle orifice (30) is in the range of 5 mm to 20 mm.

* * * * *

UNITED STATES PATENT AND TRADEMARK OFFICE

CERTIFICATE OF CORRECTION

PATENT NO. : 6,263,881 B1
DATED : July 24, 2001
INVENTOR(S) : Kuhl et al.

It is certified that error appears in the above-identified patent and that said Letters Patent is hereby corrected as shown below:

Title page,
Item [57], ABSTRACT, lines 8 and 9, delete "The nozzle orifice sweeps past the surface of the tobacco and", and insert -- The surface of the tobacco sweeps past the nozzle orifice which --.

Column 6,
Line 26, after "liquid", insert -- medium --.

Signed and Sealed this

Twenty-seventh Day of August, 2002

*Attest:*

*Attesting Officer*

JAMES E. ROGAN
*Director of the United States Patent and Trademark Office*